United States Patent [19]

Kuipers

[11] 3,953,814

[45] Apr. 27, 1976

[54] POLARIZED ELECTRO-MAGNETIC RELAY

[75] Inventor: Egbert Kuipers, Heiligenhaus, Germany

[73] Assignee: Hartmann & Braun Aktiengesellschaft, Frankfurt am Main, Germany

[22] Filed: Sept. 18, 1975

[21] Appl. No.: 614,658

[30] Foreign Application Priority Data

Sept. 21, 1974 Germany ..... 2445196

[52] U.S. Cl. ..... 335/230; 335/274

[51] Int. Cl.[2] ..... H01F 7/08

[58] Field of Search ..... 335/229, 230, 234, 274, 335/276, 253, 254

[56] References Cited

UNITED STATES PATENTS 3,518,592 6/1970 Bosch ..... 335/234

3,701,066 10/1972 Bosch et al. ..... 335/274

*Primary Examiner*—George Harris

*Attorney, Agent, or Firm*—Ralf H. Siegemund

[57] ABSTRACT

The relay has an U-shaped and E-shaped yoke member with an interconnecting permanent magnet. An U-shaped armature rocks between the yoke members and is held by springs between them. The springs are attached with one end each to the E yoke member; in order to prevent sliding of the armature or yoke parts on changing position, the springs are constructed to permit resilient length compensation and are attached with the other end to the armature beyond a temporary fulcrum on the U yoke member.

2 Claims, 7 Drawing Figures

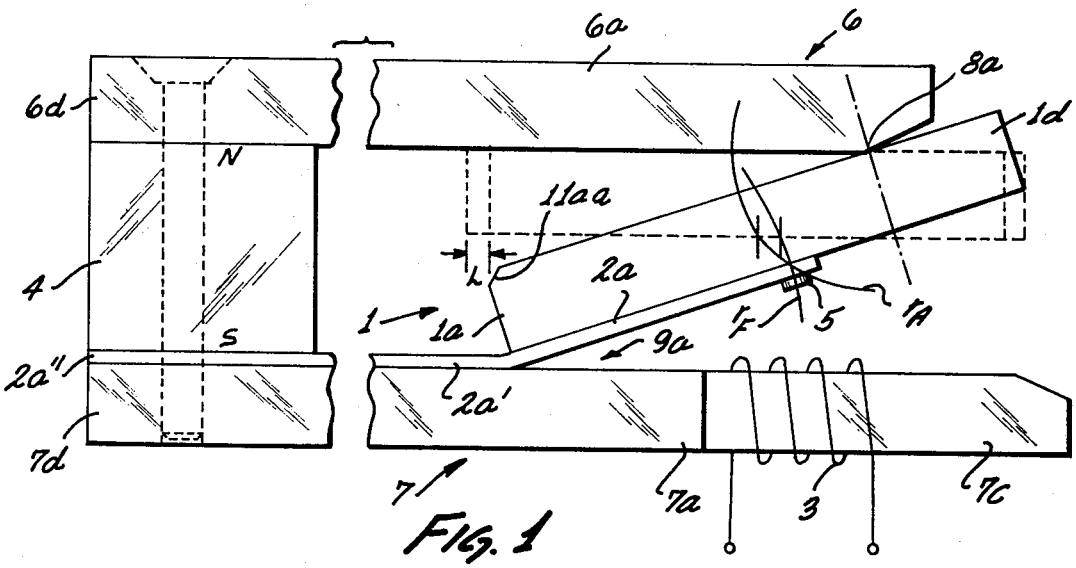
FIG. 1
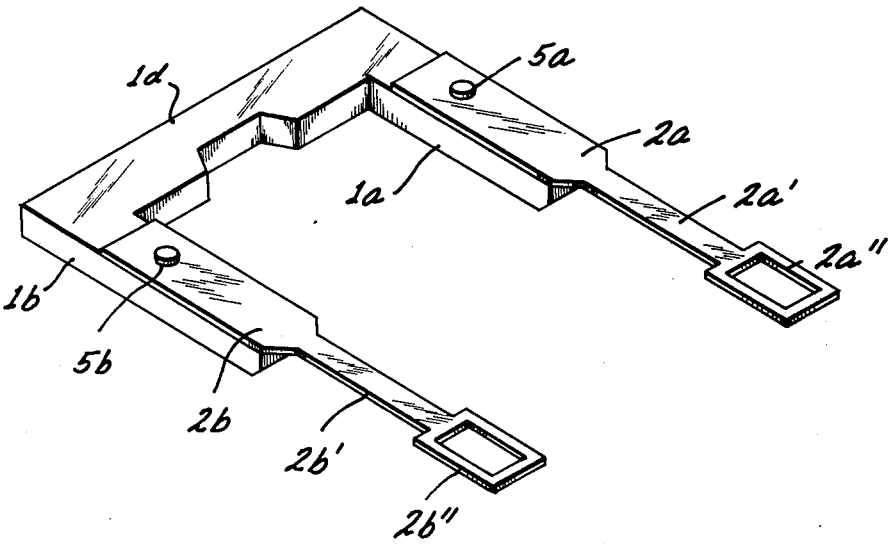
FIG. 2
FIG. 6a
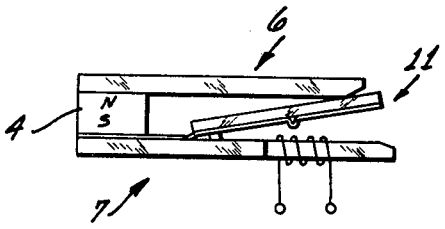
FIG. 6b
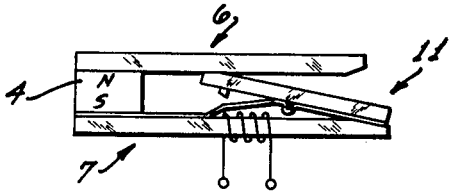

FIG. 3
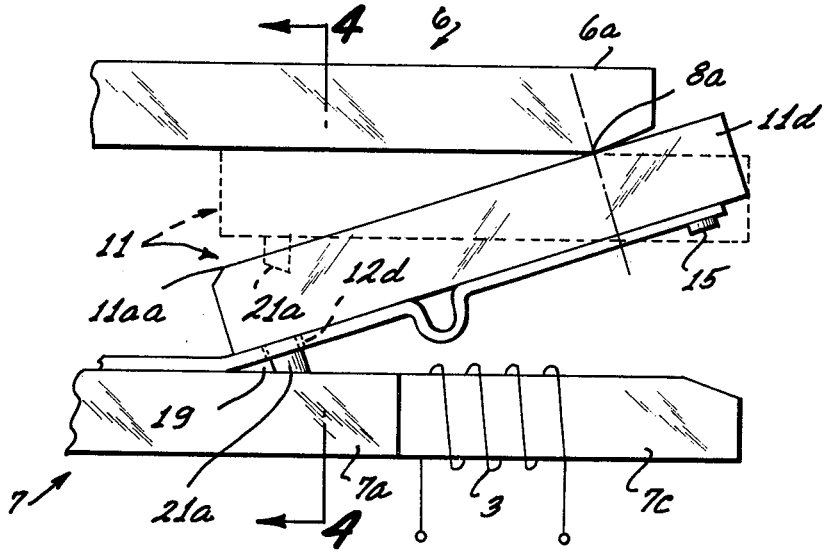
FIG. 4
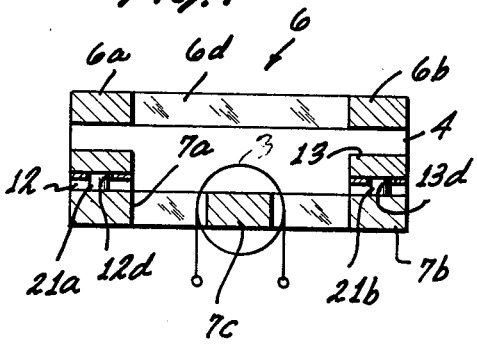
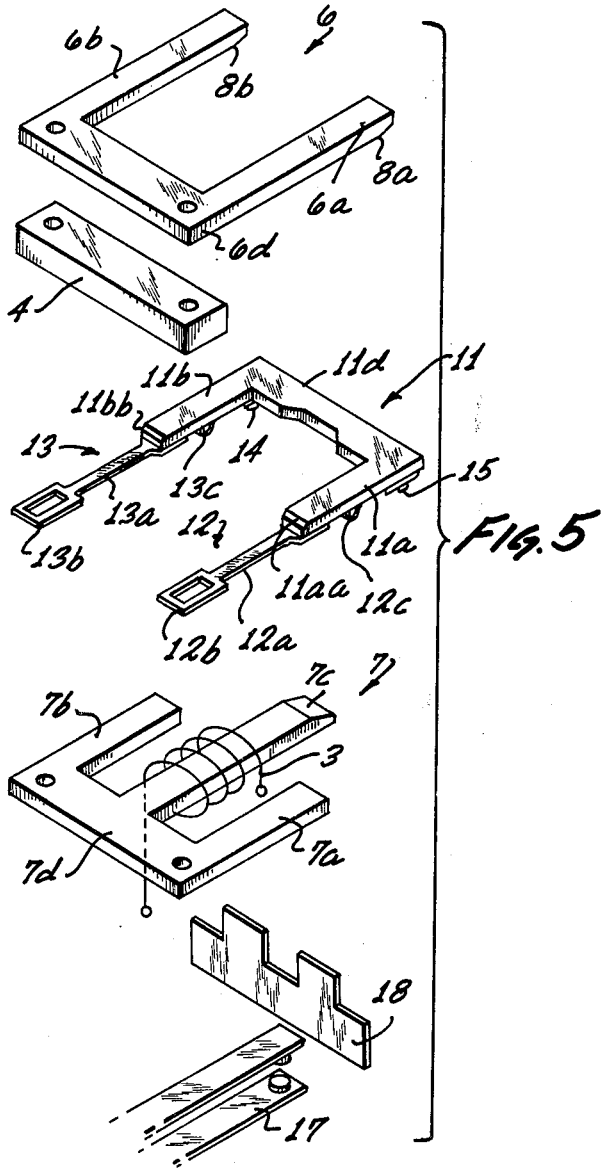
FIG. 5

POLARIZED ELECTRO-MAGNETIC RELAY

BACKGROUND OF THE INVENTION

The present invention relates to polarized electromagnetic relays and more particularly the invention relates to improvements in relays of the type disclosed in U.S. Pat. No. 3,710,290 of common assignee.

The relay to be improved by the present invention has a pair of yoke members, one being E-shaped with an extended center leg, the other member being U-shaped, and they are interconnected and spaced by a permanent magnet connected to the respective transverse bar portions of the yoke members from which the respective legs extend, so that the legs of U are aligned with the outer legs of the E. An U-shaped armature is disposed between the two yoke members and having a generally, opposed orientation of its legs, which are situated in the alignment spaces of the legs of the yoke members as defined. The invention relates specifically to the mounting of the armature between the yoke members by means of springs.

DESCRIPTION OF THE INVENTION

It is an object of the present invention to improve relays of the type outlined above.

The armature of the relay outlined above has two stable positions. The armature, at or near the transverse bar thereof, abuts the legs of the U-yoke member in one position, while the armature legs abut the outer legs of the E. In the other position one finds the transverse bar of the armature abutting the center leg of the E, while the legs of the armature abut the legs of the U-yoke member. It is a specific object of the present invention to improve the structure for providing a smooth transition from one position to the other. As will be explained with reference to the drawings, the known relay incurs slide friction between the parts on switching, pursuant to energization as well as de-energization of the relay.

In accordance with the preferred embodiment of the invention, it is suggested to use generally flat springs, but with a crimped, flexibly, possibly even resiliently length-compensating portion in each of them, to mount the armature to the E-yoke member, whereby particularly one end of each springs is fastened to the respective junction of a leg and of the transverse bar of the armature; the other ends of the springs are fastened on the E-member at a remote point of the leg ends thereof, for example, close to the connection thereof to the magnet. This way it is assured that any bearing of the armature against a yoke part for pivoting will not produce sliding of these parts against each other.

Other features of the said patent can be used also here, such as making the springs of non-ferro magnetic material and serving as a defined air gap. Here, lateral guiding of the armature can also be used, and the magnet may be thinner than the yoke member spacing, the springs providing for additional spacing in that instance.

DESCRIPTION OF THE DRAWINGS

While the specification concludes with claims particularly pointing out and distinctly claiming the subject matter which is regarded as the invention, it is believed that the invention, the objects and features of the invention and further objects, features and advantages thereof will be better understood from the following description taken in connection with the accompanying drawings, in which:

FIG. 1 is a side view of a modified version of a prior relay;

FIG. 2 is a perspective view of the armature of the relay of FIG. 1;

FIG. 3 is a side view of the assembled relay in accordance with the preferred embodiment of the invention;

FIG. 4 is a cross-section taken along line 4 — 4 of FIG. 3.

FIG. 5 is an exploded perspective view of a relay as shown in FIGS. 3 and 4; and FIGS. 6*a* and 6*b* are simplified side views of the relay of FIGS. 3, 4 and 5 showing the relay in two different rest positions.

Proceeding now to the detailed description of the drawings, I turn first to FIGS. 1 and 2, which show a modified version of the prior art relay. The relay includes an E-shaped yoke member 7 with a central, long leg 7*c* projecting beyond the two other, outer legs, of which only one, 7*a*, is visible in this figure. The same or a similar yoke member can be used as per the invention and that third leg is denoted 7*b* in FIG. 5. Reference numeral 7*d* denotes the transverse bar or portion of this yoke member from which the legs 7*a*, 7*b*, and 7*c* extend. For the sake of convenience I shall refer to this member as E-yoke or E-yoke member. The relay includes a second yoke member 6 of U-shaped configuration (or U-yoke or U-yoke member for short). This member 6 has two legs, of which only leg 6*a* is visible. Since also this U-yoke member 6 is used in the preferred embodiment of the invention, it is shown also in FIG. 3, et seq. and FIG. 5 shows also the second leg 6*b* of that U-yoke. The leg 6*a* is, in the drawing, vertically aligned with leg 7*a* of yoke member 7; the second leg 6*b* of yoke member 6 is analogously aligned with the non-visible third leg 7*b* of E yoke member 7.

The member 6 has a transverse bar portion 6*d*, which is not only aligned with transverse bar 7*d* of E yoke member 7, but the two portions or transverse bars 6*d*, 7*d* are interconnected by a permanent magnet bar 4, bolted thereto as illustrated. The magnet is polarized in the vertical direction in the drawing of FIG. 1 by operation of that magnet 4.

Reference numeral 1 denotes the armature of this relay being also of U-shaped configuration and having two legs, leg 1*a* and 1*b*, interconnected and integral with a cross bar 1*d* being the bottom of the U. As can be seen from FIG. 1, the legs, such as leg 1*a*, are respectively disposed in the alignment space between the yoke legs, which are legs 6*a* and 7*a* for leg 1*a*. FIG. 2 shows the armature separately.

The armature 1 is affixed to E yoke member 7 in that a pair of springs 2*a*, 2*b* connect the legs 1*a* and 1*b* of armature 1 to the outer legs of E yoke 7. One of the springs, 2*a*, is also seen in FIG. 1 as connecting the leg 7*a* to leg 1*a*. The other, outer leg of the E yoke member is connected by the other spring, 2*b*, which also connects to armature leg 1*b*.

The springs have eye-like ends 2 *a*'' and 2 *b*'' respectively traversed by bolts to be clamped between cross bar 7*d* and magnet 4 and fastened therewith to the yoke-magnet structure. The other ends of the springs are respectively secured to the armature legs 1*a*, 1*b* by means of bolts 5*a*, 5*b*. The springs cover thereby about 2/3 of each armature leg. The springs each have narrowed portions 2*a*', 2*b*' to avoid excessively large forces for return on deenergization of the relay.

The relay has additionally a coil 3 mounted on center leg 7*c*. The contact and slide arrangement is omitted from this figure. The legs of U-yoke member 6 have edges, such as 8*a* on leg 6*a* serving as pivot points for the armature when in the abutting position illustrated in FIG. 1. The other leg 6*b* has a similar edge. The magnetic flux path is closed through these edges, the flux extending in particular direction in each armature leg and crosses an air gap region at 9*a* as far as visible in FIG. 1.

If the coil 3 is energized in particular direction, similar poles face each other across the gap 9*a* (and the corresponding one between leg 1*b* and the second outer leg 7*b* of member 7) causing the armature legs to be repelled, and the armature pivots on the two edges including edge 8*a*. Accordingly, the armature pivots into the dotted position, whereby connecting points, such as 5*a* move along the circle $r_A$. The springs 2*a*, 2*b* will be deformed to some extent and as far as the springs are concerned, points 5*a*, 5*b* must follow a path along a circle $r_F$. Of course, the circles $r_A$ and $r_F$ intersect in the resting position of the armature illustrated in solid lines, but the divergence of the circles means that the armature is actually shifted by a distance L corresponding to the distance between the circle intersections with the dashed line denoting the fastening side of the armature when in the alternative position.

This lateral shift of the armature is carried out in engagement with the edges, such as 8*a* and amounts to a continuous wear. The same effect occurs when the relay energization continues and pivoting of armature 1 now occurs at the left hand bevelled end of the legs as the bar 1*d* is attracted by leg 7*c*. These edges of the armature legs will also slide on the legs of U-yoke 6. Aside from the wear of edges sliding over surfaces, the friction is reflected in a higher response voltage for actuating the relay.

FIGS. 3, 4 and 5 show structure, which avoids the friction of sliding, in accordance with the principles of the invention. The yoke members 6 and 7 are similarly constructed as in FIG. 1 and one can see here the second U-leg, 6*b* and the second outer E leg, 7*b*. Also, analogously, there is a coil 3 mounted on center leg 7*c*.

The armature of the relay is denoted here by reference numeral 11, having two legs 11*a* and 11*b* joined by a cross bar or transverse portion 11*d* to establish a U-shaped configuration. The legs 11*a*, 11*b* are disposed in the leg alignment spaces between E and U yoke members as defined by legs 6*a*, 7*a* and 6*b*, 7*b* respectively. Thus far, the armature is similar to armature 1 of FIGS. 1 and 2. However, the cross bar 11*d* has fastening bores at its ends from which the legs emerge. In other words, the bores are situated in the intersection of legs and bottom bar of the U. Two springs 12 and 13 are respectively affixed to armature 11 by means of bolts 14 and 15, respectively traversing these bores. The two springs have also narrowed portions 12*a*, 13*a* that project beyond the respective armature legs 11*a*, 11*b*. The springs terminate also in eyes 12*b*, 13*b* respectively for fastening to the E yoke cross-bar 7*d* and between it and the permanent magnet 4.

Each of the springs has a U-shaped loop or crimped portion 12*c* and 13*c* respectively, which is located in about the middle of the respective armature leg. These crimped portions impart longitudinal flexibility and resiliency to the springs as far as their ends and points of fastending are concerned. Additionally, each spring has an aperture, 12*d*, 13*d* adjacent the respective armature leg end, through which project ferro-magnetic pins 21*a*, 21*b* being affixed to the legs 11*a*, 11*b* and having an obliquely cut other end for abutment with the respective E yoke leg, 7*a*, 7*b*, when the armature has one of its two rest positions (FIG. 4). The pins 21*a* and 22*b* clear, of course, the apertures 12*d*, 13*d* so that the springs can move independently from the armature and vice versa, at that point which is rather remote from the fastening points 14, 15 of the armature and of the spring ends in each instance.

Reference numeral 18 refers to a slide element which engages the two armature legs adjacent cross-bar 11*d* and is shifted down therewith; the up movement being obtained by the resiliency of contacts 17 which are actuated by slide element 18, when shifted down. On relay de-energization the resiliency of the contacts pushes element 18 up.

FIG. 3 illustrates one resting position of the armature 11 corresponding to an up position of relay contact actuator 18 which in turn corresponds to open contacts 17, (FIG. 5) The resting position is specifically characterized in that the armature abuts edges 8*a* at or near the cross bar 11*d*, while the legs sit on the springs 12, 13, and pins 21*a*, 21*b* project through the apertures in the springs and sit on legs 7*a*, 7*b* of the E yoke member. Please note that the points of fastening the springs to the armature is beyond the fulcrum at edges 8*a*, 8*b* as seen from the leg ends of the armature.

Upon energizing the relay coil 3 in the proper direction, a repelling field distribution is established in zone 19 and the armature pivots up, about the edges 8*a*, 8*b*. The spring holds the armature in abutment with these edges and the spring extensions 12*c*, 13*c* provide for any length compensation needed. Moreover, once the dashed abutment position is obtained, the armature cross bar 11*d* is attracted by the center leg 7*c*, whereby the pivoting occurs at the bevelled edges 11*aa*, 11*bb* of the armature legs for the armature to assume the disposition as shown in FIG. 6, and again spring portions 12*c*, 13*c* provide for any length compensation needed during this second phase of pivoting, so that the armature does not slide.

The placement of the fastening points 14, 15 right at the cross bar 11*d*, i.e. to the other side of the fulcrum of the pivot action on edges 8*a*, *b* has the supplementary advantage that the springs develope lesser resistance during turning. This in turn is a further impediment of sliding and reduces the response by increasing switching speed.

Continuation of the energization maintains the armature in the disposition shown in FIG. 6. The springs are quite strongly deformed causing the relay armature to return to the position of FIGS. 4 and 6*a* on de-energization of the relay.

The pins 21*a*, 21*b* enhance attraction in the resting position and bypass the gap as established by the thickness of the springs. This enhances flux density in the magnetic circuit as the oblique ends of pins 21*a*, *b* rest firmly on the respective yoke legs. Thus, the attraction and holding force in retaining the armature in this resting position is enhanced and this in turn renders the relay rather shock-proof. The springs are not interposed in the magnetic flux path when the armature has the operating position of FIG. 6.

The invention is not limited to the embodiment described above, but all changes and modifications thereof not constituting departures from the spirit and scope of the invention are intended to be included.

I claim:

1. Polarized electro-magnetic relay having an E-shaped yoke member with a center and two outer legs and transverse bar, further having an U-shaped yoke member with two legs and a transverse bar, said transverse bars of said members being interconnected and spaced by a permanent magnet, so that said outer legs are respectively aligned with said legs of the U-shaped members, there being a coil on the center leg, the center leg being longer than the outer legs, the relay further having an armature of U-shaped configuration and having two legs and a transverse bar, the armature being disposed so that its transverse bar faces said center leg and the two legs are in an alignment space respectively between the two legs of the U-shaped yoke member and said outer legs the armature actuating relay contacts, the improvement comprising:

a pair of long, flat springs, each having a first end fastened to the E-shaped yoke member at the transverse bar thereof, and having a second end fastened to the transverse bar of the armature at a location from which one of the legs thereof extend, said springs each having a crimped portion having flexibility in the direction of extension of the respective spring.

2. Polarized relay as in claim 1, each leg of the armature having a pin in direct contact with the respective adjacent outer leg when the armature has a position of abutment of or near its transverse bar with the legs of the U-shaped yoke member.

* * * * *